US005206619A

United States Patent [19]

Kita

[11] Patent Number: 5,206,619

[45] Date of Patent: Apr. 27, 1993

[54] TONER CARTRIDGE

[75] Inventor: Masahiro Kita, Tokyo, Japan

[73] Assignee: Asahi Kogaku Kogyo Kabushiki Kaisha, Tokyo, Japan

[21] Appl. No.: 775,548

[22] Filed: Oct. 15, 1991

[30] Foreign Application Priority Data

Oct. 12, 1990 [JP] Japan ..... 2-107462[U]

[51] Int. Cl.[5] ..... G03G 15/06

[52] U.S. Cl. ..... 355/260; 118/653; 222/DIG.1

[58] Field of Search ..... 355/260, 200, 245, 215; 118/653; 210/258; 206/602; 222/DIG. 1

[56] References Cited

U.S. PATENT DOCUMENTS

| | | | |
|---|---|---|---|
| 4,732,277 | 3/1988 | Smith | 355/260 X R |
| 4,895,104 | 1/1990 | Yoshino et al. | 355/260 X R |
| 4,981,218 | 1/1991 | Ban et al. | 355/260 X R |
| 4,984,023 | 1/1991 | Yoshida | 355/260 |
| 5,018,560 | 5/1991 | Tsukamoto | 355/260 X R |
| 5,027,156 | 6/1991 | Kobayashi | 355/260 X R |

*Primary Examiner*—A. T. Grimley

*Assistant Examiner*—T. A. Dang

*Attorney, Agent, or Firm*—Sandler, Greenblum & Bernstein

[57] ABSTRACT

A cartridge detachably coupled to a device is provided, for supplying a substance adapted to be accommodated in the cartridge to the device through an opening formed on the device. The cartridge includes a flange portion located on a surrounding portion of the opening of the device, and a supply port to be received in the opening. The supply port is covered by a sheet member, which is folded to be double-layered and to have both end portions of the first and second layers positioned at the same side. The first layer is adhered to the peripheral surface of the supply port, and a sealing member is secured to the flange portion and positioned between the flange portion and the surrounding portion of the opening, when the cartridge is coupled to the device, for tightly closing the opening. A slit is formed through the superposed pair of the flange portion and the sealing member for passing both end portions of the sheet member so that both end portions remain outside of the cartridge when the cartridge is coupled to the device.

7 Claims, 6 Drawing Sheets

TONER CARTRIDGE

BACKGROUND OF THE INVENTION

The present invention relates to a toner cartridge which is to be coupled to the developing unit of an electrophotographic imaging apparatus for supplying toner accommodated therein to the developing device.

Conventionally, an imaging apparatus making use of so-called electrophotography, such as, an electronic copy machine, a laser beam printer, and the like are known, wherein the uniformly charged surface of a photoconductive drum is exposed to light to form a latent image, toner is adhered to the latent image to develop the same into a toner image, and the toner image is transferred to a recording sheet an fixed thereon by a fixing unit.

The developing unit of the imaging apparatus making use electrophotography is arranged such that toner accommodated in a toner accommodating portion is adsorbed by the magnetic adsorbing force of a developing roller and supplied to a development area. Since the toner is consumed by a developing operation, toner must be supplied into the toner accommodating portion as it is consumed.

In many cases, toner is supplied by using a toner cartridge which can be coupled to the developing unit for preventing contamination caused by leaked toner, and making operation of the apparatus simple. More specifically, as shown as an example in FIG. 3 showing a perspective view of a developing unit to which a toner cartridge is coupled, FIG. 4 showing a horizontal cross sectional view thereof and FIG. 5 showing a front view, partly in cross section, thereof, respectively, a cartridge mounting portion 21 is formed on the upper portion of the toner accommodating portion 22 of a developing unit 20, a toner cartridge 10 in which toner is accommodated is mounted on the cartridge mounting portion 21, and the toner falls from the toner cartridge 10 into the toner accommodating portion 22 for replenishment. Although the toner cartridge 10 becomes empty after the toner has been replenished, it serves as a cover for the toner accommodating portion 21 until toner is once again replenished for subsequent use.

The toner cartridge 10, as shown in the drawings has a toner supply port 12 defined on the lower surface thereof and a mounting flange 13 projectingly defined around the outer circumference of the toner cartridge 10. The toner cartridge 10 is mounted on the cartridge mounting portion 21 of the developing unit 20 and is hermetically sealed thereto through a flexible seal member 14, such as a sponge or the like, adhered to the lower surface of the mounting flange 13.

The toner supply port 12 is covered by a tape member 15 adhered along the outer edge thereof in a longitudinal direction. The tape member 15 is bent at the end of the portion where the tape member 15 has finished the closing of the toner supply port and returned to the side from which the toner supply port has been covered. An extreme end 15A of the tape member 15 projects to the outside of the toner cartridge through a slit 14A defined on the seal member 14 and the opening 13A defined on the mounting flange 13. The toner supply port 12 can be opened by pulling the extreme end 15A projecting to the outside of the toner cartridge and removing the tape member 15 at the end thereof where the closing of the toner supply port 12 has been finished.

Nevertheless, with the conventional arrangement as described above, a problem arises in that when the toner supply port 12 is opened by pulling the extreme end 15A projecting to the outside of the toner cartridge and removing the tape member 15 at the end thereof, where the closing of the toner supply port 12 has been finished, the seal member 14 located on the toner supply port 12 side is pulled by the tape member 15, depending upon the portion through which the tape member 15 passes, and is pulled out to the outside of the toner cartridge from the opening 13A and damaged and, thus, the sealing property of the seal member 14 is deteriorated.

More specifically, when the extreme end 15 A of the tape member 15 projecting to the outside of the toner cartridge through the opening 13A is pulled to remove the tape member 15, the tape member 15 is stretched to linearly connect the opening 13A to the edge 12A of the toner supply port 12 from which the toner supply port 12 has been closed as shown in FIG. 6A, so that the flexible seal member 14 is pressed and crushed by the tape member 15 and thus pulled out to the outside of the toner cartridge through the opening 13A and damaged as the seal member 15 moves, as shown in FIG. 6B. As a result, the opening 13A communicates with the toner accommodating portion 22 of the developing unit and toner leaks through the opening 13A.

SUMMARY OF THE INVENTION

It is therefore an object of the present invention to provide an improved toner cartridge wherein when a toner supply port is opened by removing a tape member, a seal member is not pulled by the tape member and not damaged.

For the above object, according to the present invention, there is provided a cartridge to be coupled to a device for supplying a substance accomodated in the cartridge to the device through an opening formed on the device, comprising:

a flange portion located on the surrounding portion of the opening of the device;

a supply port to be received in the opening, the supply port being covered by a sheet member, the sheet member being folded to be double-layered and to have both end portions of the first and second layers positioned at the same side, the first layer being adhered to the peripheral surface of the supply port; and a sealing member secured to the flange portion to be positioned between the flange portion and the surrounding portion of the opening, when the cartridge is coupled to the device, for tightly closing the opening.

wherein a slit is formed through the superposed pair of the flange portion and the sealing member for passing both end portions of the sheet member so that both end portions remain outside when the cartridge is coupled to the device, whereby the supply port is opened by pulling outwardly the end portion of the second layer of the sheet member, after the cartridge is coupled to the device.

Further, the cartridge is a toner cartridge to be coupled to a developing device employed in an electrophotographic imaging device, for supplying toner to the developing device.

Optionally, the supply port is formed at the end of the downwardly tapered portion from the portion where the flange portion is formed.

DESCRIPTION OF THE ACCOMPANYING DRAWINGS

DESCRIPTION OF THE EMBODIMENTS

Figure 1:
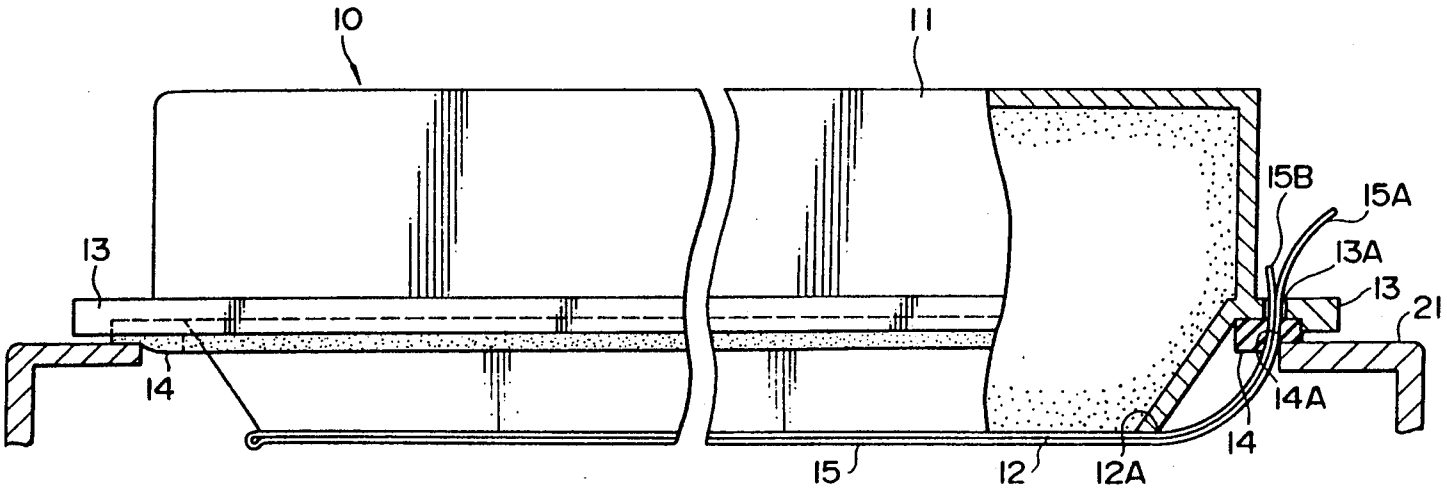
FIG. 1 is a front view, partly in cross section, of a toner cartridge as an embodiment of the present invention.

FIG. 1 is a front view, partly in cross section, of a toner cartridge 10 according to an embodiment of the present invention.

The toner cartridge 10, shown in the figure is arranged such that a rectangular parallelepiped toner accommodating container 11 of a predetermined capacity has a toner supply port 12 defined on the lower surface thereof along a longitudinal direction and a mounting flange 13 projecting around the entire outer periphery thereof.

A flexible seal member 14, such as, a sponge or the like, is adhered to the lower surface of the mounting flange 13. The mounting flange 13 is mounted on the cartridge mounting portion 21 of a developing unit through the seal member 14 so that airtightness is kept therebetween.

The lower surface of the toner accommodating container 11 is formed to a funnel shape which is gradually narrowed toward the extreme end thereof. The toner supply port 12 is opened at the lower end thereof, and the plan view of the toner supply port 12 is similar to that of the container 11 although smaller than the toner accommodating container 11.

When toner is accommodated as shown in FIG. 1, a seal tape 15 such as, a flexible film made of plastic material, is adhered to the outside of the toner cartridge edge of the toner supply port 12 and the toner accommodating container 11 is sealed by the seal tape 15.

The seal tape 15 covers the entire toner supply port 12 and is bent at one end in the longitudinal direction thereof and returned to the other end. The extreme end 15A of the seal tape 15 is overlapped with the other end 15B thereof and projects to the outside of the toner cartridge through the slit 14A defined on the seal member 14 and the opening 13A defined to the mounting flange 13. Note that the amount of the extreme end 15A projecting from the outside of the toner cartridge is larger than that of the other end 15B.

Accordingly, with the toner cartridge 10 arranged as described above, when the extreme end 15A of the seal tape 15 projecting from the outside of the toner cartridge through the opening 13A of the mounting flange 13 is pulled after the toner cartridge 10 has been mounted on the cartridge mounting portion of the developing unit 21, the seal tape 15 is removed from the side thereof opposite to the side where the seal tape 15 projects (the side where the seal tape 15 is bent and returned), so that the toner supply port 12 is opened to allow accommodated toner to be replenished through the toner supply port 12 to the developing unit.

Figure 2:
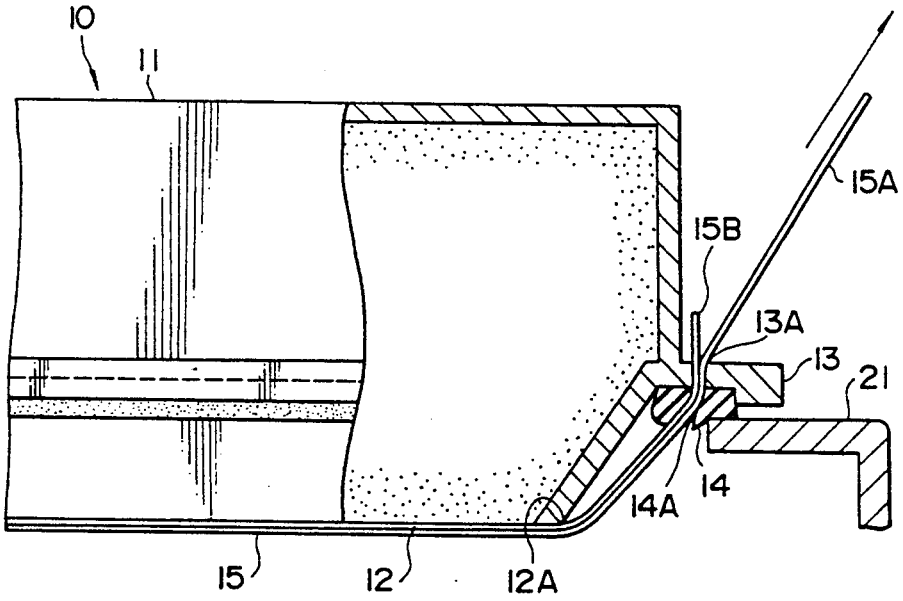
FIG. 2 is a fragmentary cross sectional of FIG. 1. showing an operating state.
Figure 3:
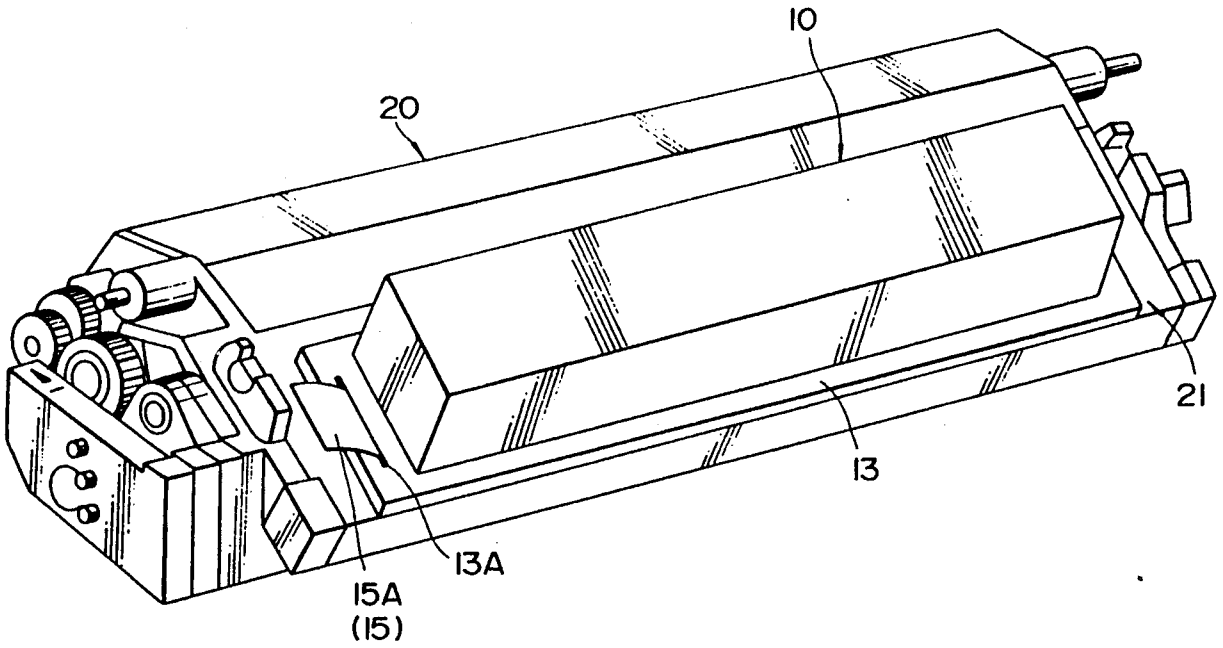
FIG. 3 PRIOR ART
FIG. 3 is a perspective view of a prior art developing unit on which a toner cartridge is mounted.
Figure 4:
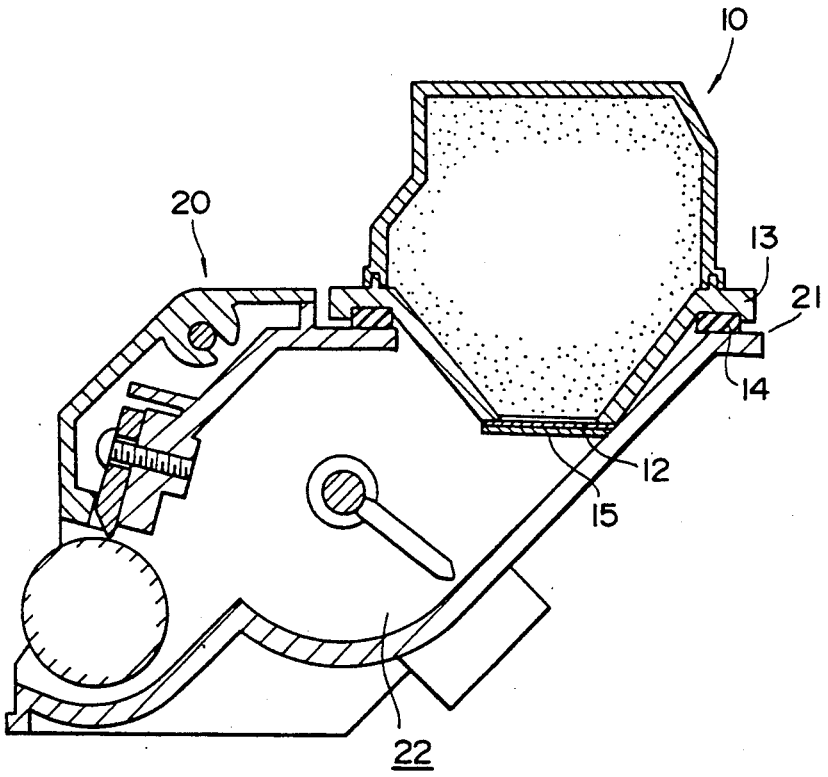
FIG. 4 PRIOR ART
FIG. 4 is a horizontal cross sectional view of FIG. 3.
Figure 5:
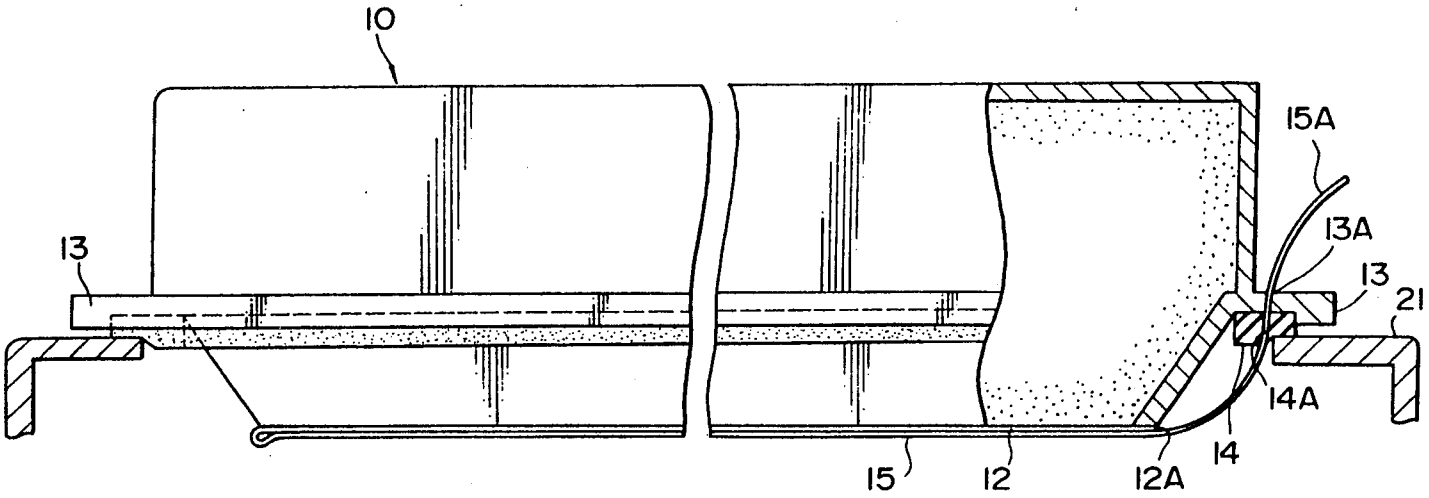
FIG. 5 PRIOR ART
FIG. 5 is a longitudinal cross sectional view of FIG. 3.
Figure 6A:
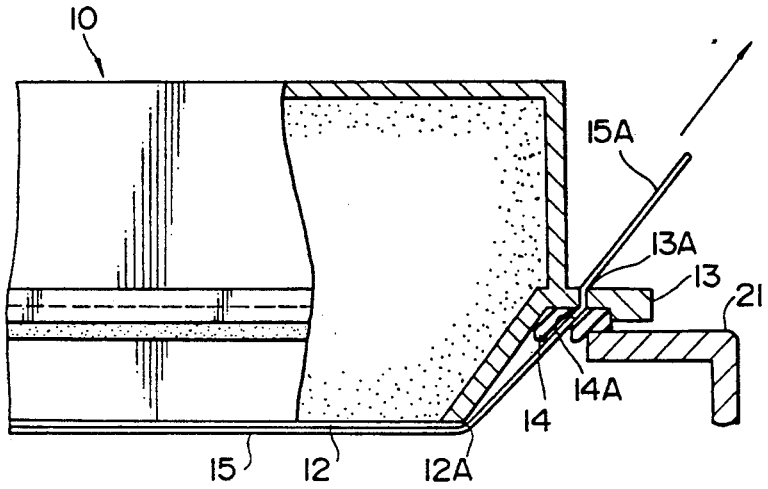
FIG. 6A PRIOR ART
FIGS. 6A and 6B are diagrams explaining the operation of the prior art.
Figure 6B:
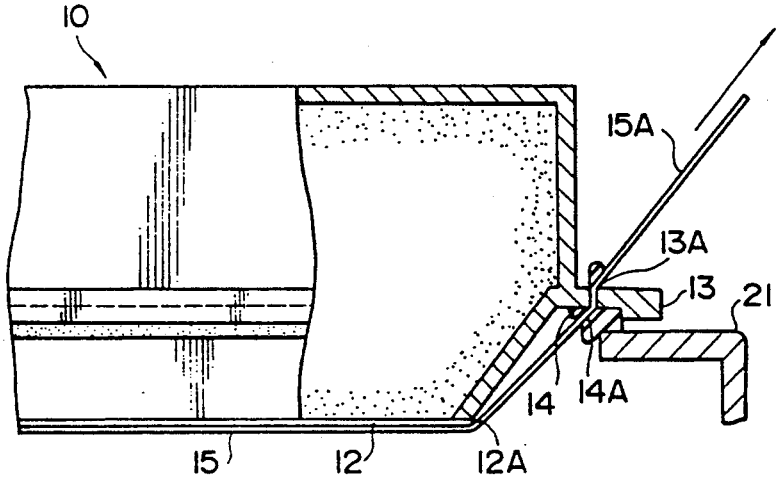
FIG. 6B PRIOR ART

When the extreme end 15A is pulled and removed, the seal tape 15 is stretched to linearly connect the opening 13A to the edge 12A of the toner supply port 12 and thus the flexible seal member 14 is pressed and crushed by the seal tape 15. At this time, however, as shown in FIG. 2, there exists the other end 15B of the seal tape 15 which does not move until the toner supply port 12 has been opened between the portion of the seal tape 15, which moves when removed, and the seal member 14, and thus the seal member 14 is not pulled out to the outside of the toner cartridge by being pulled by the seal tape 15 as it is removed.

After the seal tape 15 has been removed from the toner supply port 12 to open the same and the seal tape 15 has been entirely pulled out from the opening 13A, the seal member 14 returns to a state similar to that as shown in FIG. 1 to keep airtightness.

According to the toner cartridge described above, since the portion of the tape member which does not move is interposed between the portion of the tape member, which moves when removed, and the seal member 14, the seal member 14 is prevented from being damaged by being pulled by the tape member which is being removed.

The present disclosure relates to subject matter contained in Japanese Utility Model Application No. HEI 2-107462 (filed on Oct. 12, 1990) which is expressly incorporated herein by reference in its entirety.

What is claimed is:

1. A toner cartridge to be coupled to a developing device for supplying a toner accommodated in said cartridge to said developing device through an opening formed on said developing device, comprising:

a main body in which the toner is adapted to be accommodated;

a flange portion formed on said main body, to be seated on a peripheral portion of said opening of said developing device;

a supply port which is formed on said main body, to be received in said opening and through which the toner is supplied from said main body;

a sheet member for removably covering said supply port, said sheet member being folded in a double-layered manner to have a first layer and a second layer and both end portions of said sheet member being positioned at one side of said cartridge, said first layer being adhered to a peripheral surface of said supply port in a detachable manner;

a sealing member interposed between said flange portion and said peripheral portion of said opening, when said cartridge is coupled to said developing device, for tightly closing said opening; and slits which are formed through superposed portions of said flange portion and said sealing member and communicating with each other, for passing said both end portions of said sheet member so that said both end portions protrude outside from said main body when said cartridge is coupled to said developing device, wherein said supply port is opened when one end portion of said second layer of said sheet member is pulled out.

2. The toner cartridge according to claim 1, wherein the toner cartridge is detachably coupled to said developing device employed in an electrophotographic imaging device, for supplying toner to said developing device.

3. The toner cartridge according to claim 1, wherein said sheet member comprises a flexible film made of plastic.

4. The toner cartridge according to claim 1, wherein said sealing member comprises a sponge member.

5. The toner cartridge according to claim 1, wherein said supply port is formed at an end of a downwardly tapered portion of the toner cartridge adjacent a portion where said flange portion is formed.

6. The toner cartridge according to claim 1, wherein an end portion of said second layer of said sheet member is further protruded outside from said main body than an end portion of said first layer of said sheet member.

7. A cartridge for supplying a substance accommodated in the cartridge to a device through an opening formed on the device, comprising:

a flange portion that is seated on a peripheral portion of said opening of the device when the cartridge is coupled to the device;

sealing means for sealing a supply port of the cartridge that is received in said opening, said sealing means comprising a folded double-layered sheet member comprising a first layer detachably adhered to a peripheral surface of said supply port and a second layer, said first and second layers of said sheet member defining end portions that are each positioned at one side of the cartridge; and a flexible seal member arranged between said flange portion and said peripheral portion for sealing said opening when the cartridge is coupled to the device, wherein said seal member comprises a slit for communicating with a slit formed in said flange portion, said end portions of said first and second layers being passed through said slits so that both protrude outside of the cartridge, and said supply port being opened when said protruding end portion of said second layer is pulled out through said slits.

* * * * *